US006604510B2

(12) United States Patent
Scollard et al.

(10) Patent No.: US 6,604,510 B2
(45) Date of Patent: Aug. 12, 2003

(54) FUEL SYSTEM INCLUDING A FUEL INJECTOR DIRECTLY MOUNTED TO A FUEL RAIL

(75) Inventors: Joseph E. Scollard, Suffolk, VA (US); James R. Morris, Newport News, VA (US); Mehran K. Rahbar, Virginia Beach, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/969,144

(22) Filed: Oct. 3, 2001

(65) Prior Publication Data

US 2002/0038650 A1 Apr. 4, 2002

Related U.S. Application Data

(60) Provisional application No. 60/237,891, filed on Oct. 4, 2000.

(51) Int. Cl.[7] ..... F02M 55/02

(52) U.S. Cl. ..... 123/470; 123/456; 285/133.6

(58) Field of Search ..... 123/468, 469, 123/470, 472, 456, 467; 285/133.11, 133.5, 133.6; 239/600, 585.1–585.5

(56) References Cited

U.S. PATENT DOCUMENTS

| | | | | | |
|---|---|---|---|---|---|
| 4,457,280 | A | | 7/1984 | Hudson et al. | 123/470 |
| 4,660,524 | A | * | 4/1987 | Bertsch et al. | 123/468 |
| 4,971,014 | A | * | 11/1990 | Usui | 123/470 |
| 5,018,499 | A | * | 5/1991 | Usui | 123/456 |
| 5,775,302 | A | * | 7/1998 | Guido et al. | 123/468 |
| 5,979,945 | A | * | 11/1999 | Hitachi et al. | 285/125.1 |
| 6,126,208 | A | * | 10/2000 | Asada et al. | 285/133.4 |
| 6,321,719 | B1 | | 11/2001 | Schwegler | 123/467 |
| 6,374,809 | B2 | | 4/2002 | Satou | 123/470 |
| 6,431,151 | B1 | * | 8/2002 | Gmelin | 123/470 |

FOREIGN PATENT DOCUMENTS

| | | |
|---|---|---|
| EP | 2000320421 | 11/2000 |
| JP | WO 98 15733 A | 4/1997 |
| JP | 1 094 217 A2 | 4/1998 |
| JP | 10-205409 | 8/1998 |

* cited by examiner

*Primary Examiner*—Carl S. Miller

(57) ABSTRACT

A fuel system has a fuel injector directly mounted with a fuel rail. The fuel rail has a body with interior and exterior surfaces. The interior surface defines a volume. The exterior surface surrounds the interior surface. An aperture extends between the interior and exterior surfaces in fluid communication with the volume. The fuel injector has an inlet tube with an inside surface that defines a flow path through a portion of the fuel injector, and an outside surface that surrounds the inside surface. The fuel injector is disposed so that the flow path is in fluid communication with the volume. A rigid connection is disposed between at least one of the interior and exterior surfaces of the fuel rail and the outside surface of the inlet tube, the rigid connection securing and hermetically sealing the fuel rail with the fuel injector.

20 Claims, 3 Drawing Sheets

FUEL SYSTEM INCLUDING A FUEL INJECTOR DIRECTLY MOUNTED TO A FUEL RAIL

CLAIM FOR PRIORITY

This application claims priority to prior U.S. provisional application No. 60/237,891, entitled "Laser Welded Fuel Injectors Into Fuel Rail Assembly" filed Oct. 4, 2000, the disclosure of which is hereby incorporated by reference herein in its entirety.

FIELD OF THE INVENTION

The invention relates to a fuel system, and more particularly to a fuel system including a fuel injector rigidly connected with a fuel rail. The rigid connection secures and hermetically seals the fuel injector with the fuel rail, and therefore obviates the need for a clip to secure and an elastomeric member to seal the fuel injector with the fuel rail.

It is known to use a rail to deliver fuel to an injector in a conventional fuel delivery system. In the conventional system, an elastomeric member (for example, an O-ring), is disposed on the inlet of the injector. A separate cup that is brazed to the rail receives the injector inlet. By this arrangement, a hermetic seal is formed between the inlet having the elastomeric member and the cup. It is also known to use a clip to secure the injector to the rail and prevent separation.

However, the conventional system suffers from a number of disadvantages. The use of a clip to secure and an elastomeric member to seal the injector with the rail increases the cost and complexity of assembly. Further, it is believed that a more hermetically sealed flow path can be achieved through other assembly processes that eliminate the elastomeric member. For these reasons, it is desirable to provide a fuel system having a fuel injector that is rigidly connected to a fuel rail, the rigid connection securing and hermetically sealing without the use of a clip and an elastomeric member.

SUMMARY OF THE INVENTION

The present invention provides a fuel system having a fuel injector directly mounted with a fuel rail. The fuel rail has a body with interior and exterior surfaces. The interior surface defines a volume. The exterior surface surrounds the interior surface. An aperture extends between the interior and exterior surfaces in fluid communication with the volume. The fuel injector has an inlet tube with an inside surface that defines a flow path through a portion of the fuel injector, and an outside surface that surrounds the inside surface. The fuel injector is disposed so that the flow path is in fluid communication with the volume. A rigid connection is disposed between at least one of the interior and exterior surfaces of the fuel rail and the outside surface of the inlet tube, the rigid connection securing and hermetically sealing the fuel rail with the fuel injector.

The present invention also provides a method of forming a fuel system. The method includes providing an aperture in a fuel rail with a body having an interior surface to define a volume and an exterior surface surrounding the interior surface, the aperture in fluid communication with the volume, and rigidly connecting an inlet tube of a fuel injector with at least one of the interior and exterior surfaces of the fuel rail that surrounds the aperture to secure and hermetically seal the inlet tube of the fuel rail with the volume of the fuel injector.

BRIEF DESCRIPTIONS OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
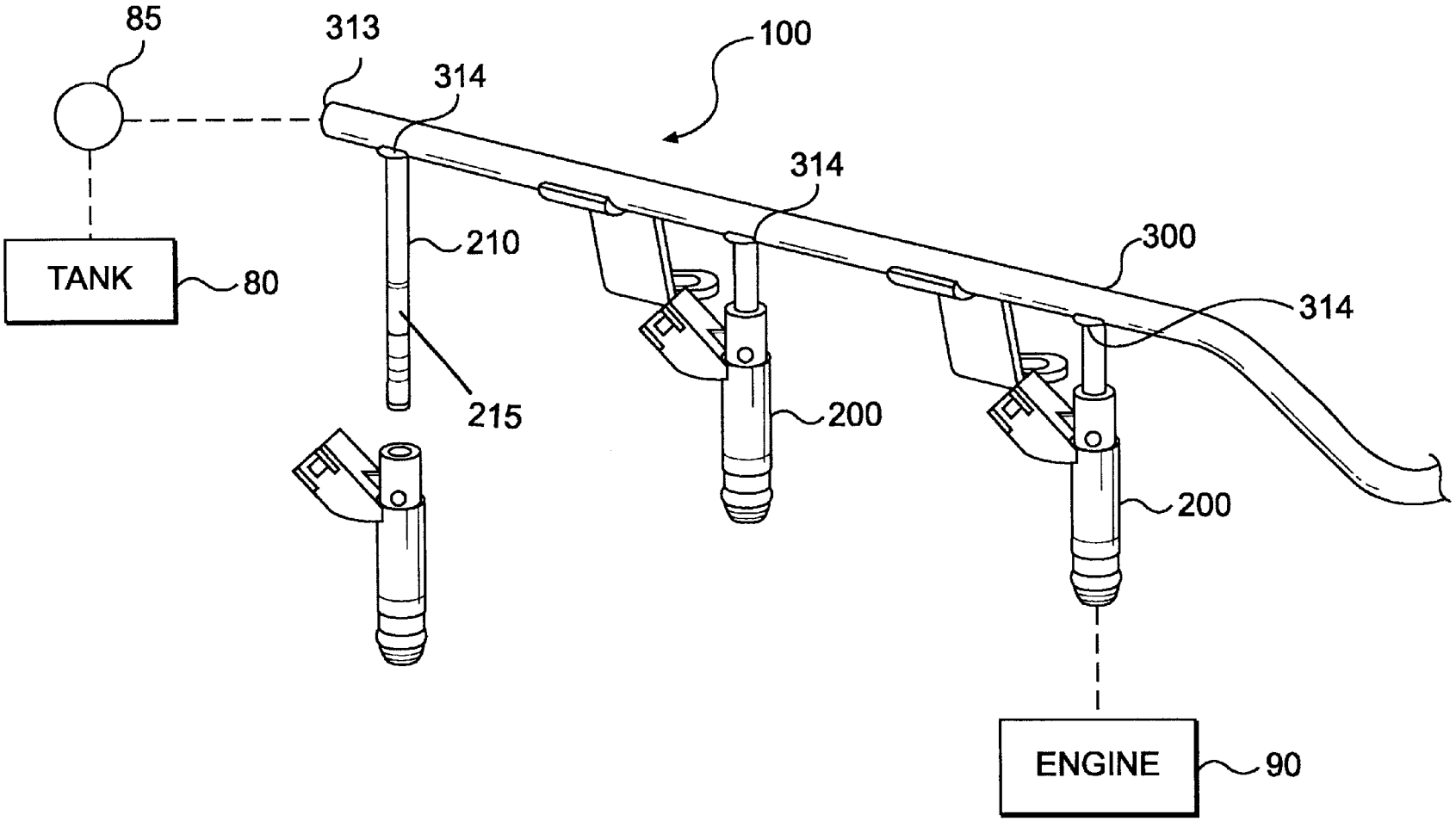
FIG. 1 shows a perspective representation of the fuel system having a fuel injector directly mounted to a fuel rail by a rigid connection.

FIG. 1 shows a preferred embodiment of a fuel system having a fuel injector rigidly connected to a fuel rail. The rigid connection secures and hermetically seals the fuel injector and the fuel rail, and, more preferably, secures and hermetically seals the fuel injector inlet tube and a surface of the fuel rail body. Although the figures show specific, preferred embodiments, it is to be understood that the fuel system can include any rigid connection that both secures and hermetically seals a fuel injector with a fuel rail. The hermetic seal prevents fuel leakage from between the fuel injector and the fuel rail during normal operating conditions of the fuel system. Preferably, the normal range of operation for the fuel system is about 35 psi to about 75 psi, and the hermetic seal has a burst pressure in excess of about 250 psi. The rigid connection obviates the need for a clip to secure and an elastomeric member to hermetically seal the fuel injector with the fuel rail. Hydrocarbon leakage within the fuel system of the preferred embodiment is believed to be greatly reduced as compared to the conventional system, because (1) any leakage that may occur between the rigidly connected fuel injector and the fuel rail should be much less than leakage past an elastomeric member between the injector and the rail of the conventional system, and (2) leakage through the elastomeric member itself is eliminated because the elastomeric member is not utilized.

The fuel system 100 includes a fuel injector 200 rigidly connected with a fuel rail 300. The fuel system 100 is installed in a motor vehicle, and, in a preferred embodiment, is installed in an automobile. Fuel stored in a tank 80 is delivered at pressure by a fuel pump 85 to an engine 90 by way of a fuel flow path from the fuel rail 300 to the fuel injector 200.

Figure 2:
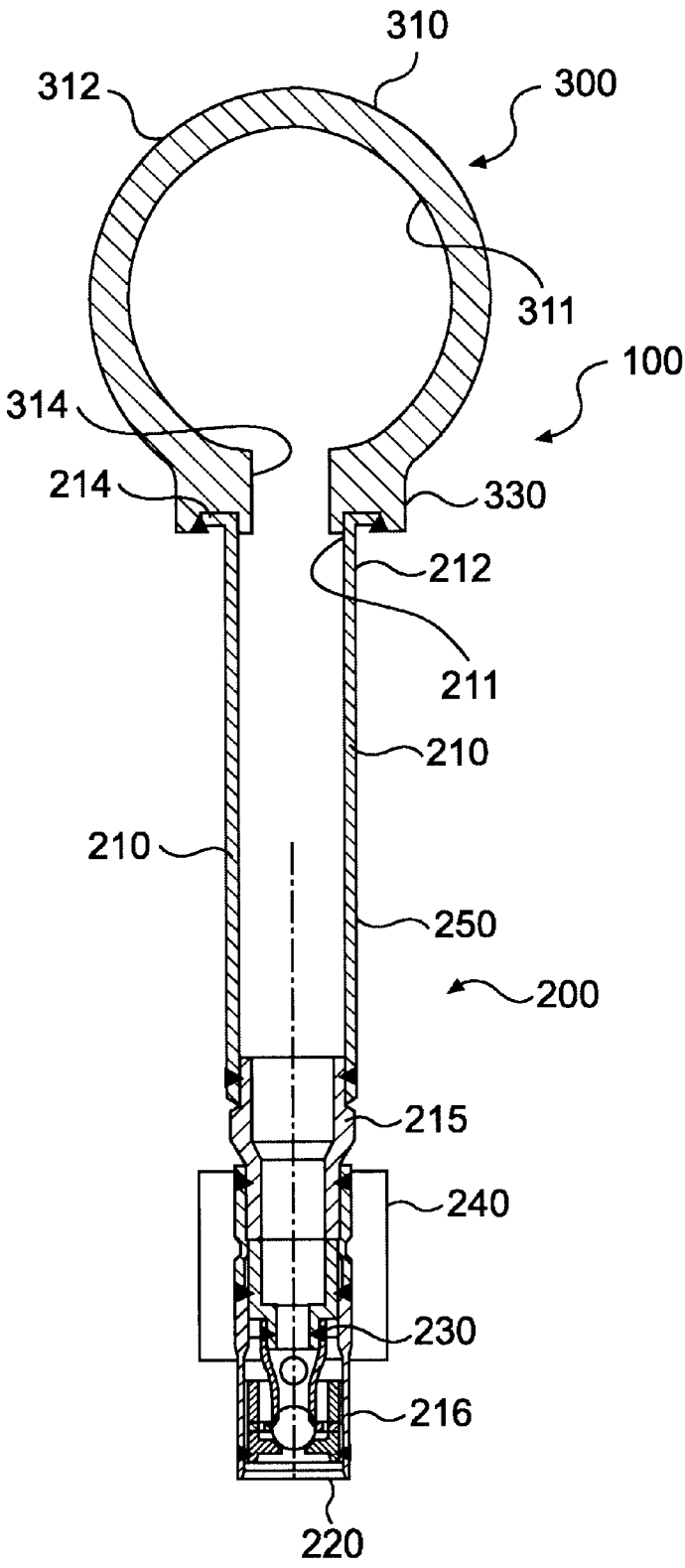
FIG. 2 shows a partial cross-sectional view of an embodiment of the rigid connection between a fuel injector and a fuel rail.
Figure 3:
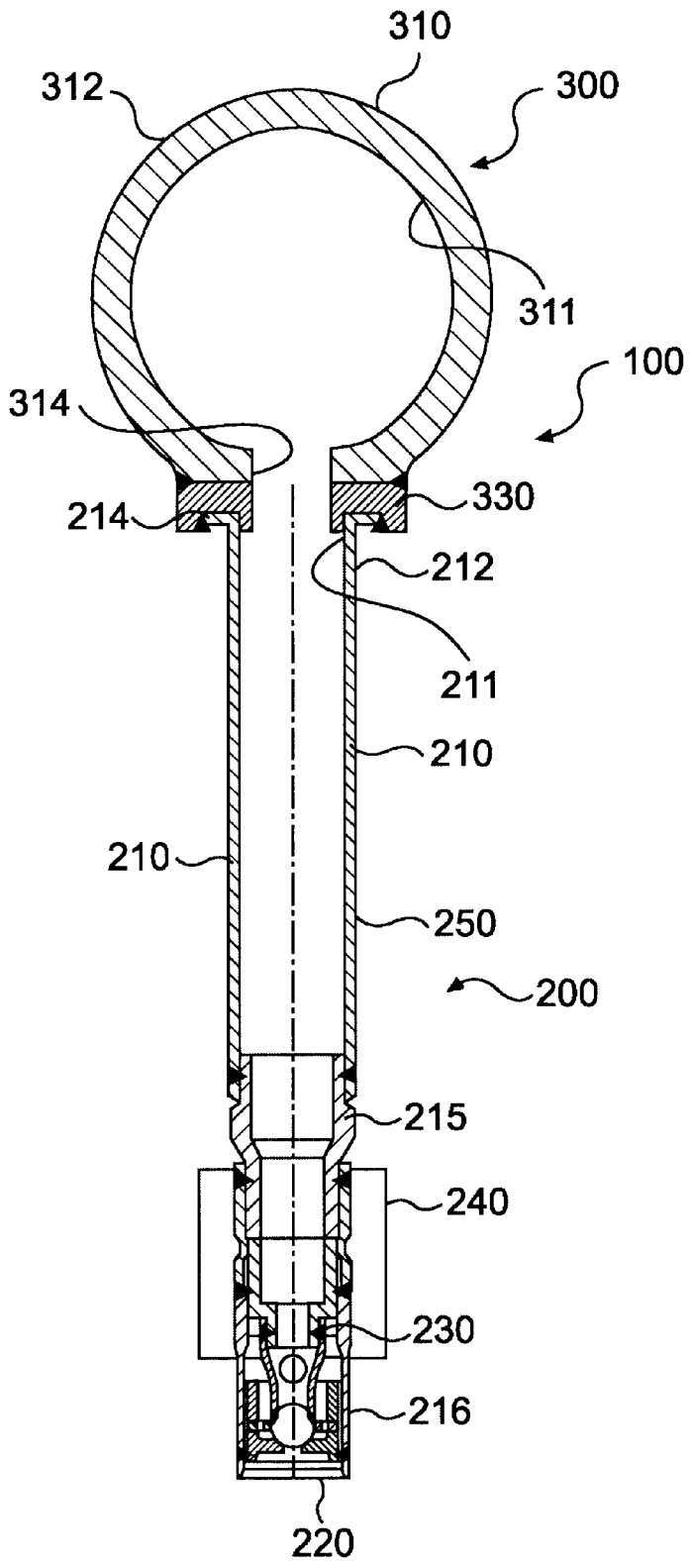
FIG. 3 shows a partial cross-sectional view of another embodiment of the rigid connection between a fuel injector and a fuel rail.

The fuel injector 200 is mounted to the fuel rail 300 with a rigid connection (to be discussed in detail). FIG. 1 shows a first preferred embodiment of fuel injector 200 that includes an outer cover surrounding a flow metering member that includes an electromagnetic actuator. FIGS. 2 and 3 shows a second preferred embodiment of the fuel injector 200 having a particular valve metering arrangement. The fuel injector 200 includes an inlet tube 210 having an interior surface 211 to define a portion of the fuel flow path through the injector 200, and an exterior surface 212 that surrounds and is coaxial with the interior surface 211. The exterior surface 212 includes a protrusion 214 that encircles an entire perimeter of a terminal end of the inlet tube 210. In the preferred embodiments shown in the figures, the exterior surface 212 and the protrusion 214 of the inlet tube 210 are rigidly connected with the fuel rail 300. However, it is to be understood that any portion of the inlet tube 210, and any other portion of the fuel injector 200, can be connected with the fuel rail 300, so long as the connection secures and hermetically seals the fuel injector 200 with the fuel rail 300.

In the preferred embodiment shown in the drawings, the fuel injector 200 includes a tube assembly 250 is formed by the inlet tube 210, a pole piece 215, a sleeve 216, and the aperture 220. A valve assembly 230 including an armature positionable to permit and prohibit fluid flow through the aperture 220 is disposed entirely within the tube assembly 250. An actuator assembly 240 cinctures the tube assembly 250 such that electromagnetic signals position the valve assembly 230 to open and close the fuel injector 200 in response thereto. Thus, formation of the rigid connection can be made between the fuel rail 300 and the tube assembly 250 including the valve assembly 230, such that completion of the fuel injector 200 can be achieved by disposing the actuator assembly 240 on the rigidly connected tube assembly 250. Although not shown, the actuator assembly 240 can be surrounded by a cover to provide for electrical connection with a socket.

Although the figures show examples of the tube assembly 250 extending an entire length of the fuel injector 200 and containing the valve assembly 230, it should be understood that the tube assembly 250 need only provide a portion of the flow path through the fuel injector 200, and need not house and retain the valve assembly 230.

The fuel rail 300 is rigidly connected with fuel injector 200. The fuel rail 300 includes a body 310 having an interior surface 311 to define a portion of the fuel flow path, an exterior surface 312 surrounding and coaxial with the interior surface 311, and an inlet 313 and an aperture 314 in fluid communication with the volume. The inlet 313 receives fuel, and the aperture 314 delivers fuel to the fuel injector inlet 210. In the preferred embodiment shown in the drawings, the body 310 has an about circular cross-section. However, it should be understood that the body 310 can be any shape, including rounded, oval, square, and rectangular, so long as the fuel injector 200 can be directly mounted thereto by a rigid connection that secures and hermetically seals without the use of additional clip and elastomeric members. Preferably, the fuel rail 300 is manufactured by assembly of tubular elements.

A projection 330 is formed on the exterior surface 312, extending in a direction away from the volume and from the exterior surface 312. The projection 330 surrounds at least a portion of the aperture 314, and is configured to permit rigid connection with the fuel injector 200. Although FIGS. 2 and 3 show examples of specific embodiments of the projection 330 and the rigid connections therewith, it should be understood that the projection 330 can be any portion of the fuel rail 300 that permits mounting of the fuel injector 200 to secure and hermetically seal without the use of a clip and an elastomeric member.

FIG. 2 shows an example of a projection 330 that is formed by deformation of a portion of the fuel rail 300. Specifically, the projection 330 is formed by extruding a portion of the body 310 in a direction away from the exterior surface 312 and the volume during the formation of the aperture 314. The projection 330 also includes a connecting portion to be disposed within the inlet tube 210 of the fuel injector 200. By this arrangement, the entire projection 330 is unitary and contiguous with the body 310, and no additional connection between the exterior surface 312 and the projection 330 is needed to ensure a hermetic seal therebetween. As shown in the figures, the projection 330 is formed and shaped to facilitate rigid connection with the fuel injector 200, and, in the more preferred embodiment, with the inlet tube 210. Preferably, the projection 330 is manufactured with a specialized die, and, more preferably, is manufactured with a T-drill. It should be understood, in a preferred embodiment, that the projection 330 can be any portion formed by deformation of the body 310 that permits a rigid connection with the fuel injector 200.

As discussed above, the rigid connection seals and hermetically secures the fuel injector 200 with the fuel rail 300, and, in a more preferred embodiment, seals the inlet tube 210 with the projection 330. The rigid connection seals and hermetically secures the fuel injector 200 with the fuel rail 300 without the use of additional clip and elastomeric members. Preferably, the rigid connection is formed by a weld, and, in a more preferred embodiment, is formed by laser welding. As shown in the embodiment of FIG. 2, the rigid connection secures and hermetically seals the exterior 212 and protrusion 214 of the inlet tube 210 with the projection 330.

The fuel system 100 of FIG. 2 is preferably assembled as follows. The tube assembly 250 including the valve assembly 230 of the fuel injector 200 is inserted over the connecting portion of the projection 330. The rigid connection is formed between the exterior 212 and the protrusion 214 of the inlet tube 210 and the projection 330, such that the fuel injector 200 is secured and hermetically sealed with the fuel rail 300. Assembly of the fuel injector 200 is completed by the disposition of the actuator assembly 240 on the tube assembly 250.

FIG. 3 shows an example of a projection 330 that is formed by connecting a separate adapter to the fuel rail 300. Specifically, the projection 330 is formed by hermetically connecting the adapter to the exterior surface 312 adjacent to the aperture 314, the adapter including a portion to be disposed within the inlet tube 210 of the fuel injector 200. Preferably, the hermetic connection between the exterior surface 312 and the projection 330 is formed by welding, and, more preferably, is formed by laser welding. However, it is to be understood that the connection can be formed by any process that produces a sufficiently hermetic seal. The exterior surface 312 is locally deformed to form a flat surface that facilitates hermetic sealing of the projection 330 with the body 310. However, it is to be understood that any or no treatment of the exterior surface 312 can be performed, so long as a sufficiently hermetic seal is formed between the projection 330 and the fuel rail 300.

As discussed above, in a more preferred embodiment, the rigid connection hermetically seals the inlet tube 210 of the fuel injector 200 with the projection 330, without the use of additional clip and elastomeric members. Preferably, the rigid connection is formed by a weld, and, in a more preferred embodiment, is formed by laser welding. As shown in the embodiment of FIG. 3, the rigid connection secures and hermetically seals the exterior 212 and protrusion 214 of the inlet tube 210 with the projection 330.

The fuel system 100 of FIG. 3 is preferably assembled as follows. The projection 330 is hermetically sealed with the exterior surface 312, thereby forming the fuel rail 300. The tube assembly 250 including the valve assembly 230 of the fuel injector 200 is inserted over the connecting portion of the projection 330. The rigid connection is formed between the exterior 212 and the protrusion 214 of the inlet tube 210 and the projection 330, such that the fuel injector 200 is secured and hermetically sealed with the fuel rail 300. Assembly of the fuel injector 200 is completed by the disposition of the actuator assembly 240 on the tube assembly 250.

In a preferred embodiment, the fuel rail 300 is a cylindrical fuel rail that extends along a substantially straight axis, the fuel rail including a multiplicity of fuel injectors 200 rigidly connecting with a plurality of apertures 314. The fuel rail 300 can also include a plurality (at least 2) parallel rails fluidly connected via a connecting tube. The fuel injectors 200 can be equally spaced along the parallel axes of the parallel rails, and rigidly connected thereto.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it will have the full scope defined by the language of the following claims, and equivalents thereof.

What is claimed is:

1. A fuel system comprising:

a fuel rail having a body with an interior surface defining a volume, an exterior surface surrounding the interior surface, and at least one aperture disposed between the interior and exterior surfaces in fluid communication with the volume;

at least one fuel injector having an inlet tube assembly containing a valve assembly and an inlet tube, the inlet tube including an inside surface defining a flow path through a portion of the fuel injector and an outside surface surrounding the inside surface, the flow path in fluid communication with the volume; and a rigid connection between at least one of the interior and exterior surfaces of the fuel rail contiguous to the outside surface of the inlet tube that secures and hermetically seals the fuel rail with the at least one fuel injector.

2. The fuel system according to claim 1, wherein the rigid connection is between the exterior surface of the fuel rail and the outside surface of the inlet tube.

3. The fuel system according to claim 2, wherein the exterior surface of the fuel rail comprises a projection, the rigid connection between the projection and the outside surface of the inlet tube.

4. The fuel system according to claim 3, wherein the projection is disposed on and extends away from the exterior surface of the fuel rail.

5. The fuel system according to claim 4, wherein the projection is formed by extruding a portion of the body of the fuel rail.

6. The fuel system according to claim 5, wherein the rigid connection is formed by welding.

7. A fuel system comprising:

a fuel rail having a body with an interior surface defining a volume, an exterior surface surrounding the interior surface, and at least one aperture disposed between the interior and exterior surfaces in fluid communication with the volume; and at least one fuel injector having an inlet tube with an inside surface defining a flow path through a portion of the fuel injector and an outside surface surrounding the inside surface, the flow path in fluid communication with the volume; and a rigid connection between at least one of the interior and exterior surfaces of the fuel rail and the outside surface of the inlet tube that secures and hermetically seals the fuel rail with the at least one fuel injector, the rigid connection is between the exterior surface of the fuel rail and the outside surface of the inlet tube, the exterior surface of the fuel rail comprises a projection, the rigid connection between the projection and the outside surface of the inlet tube the projection is disposed on and extends away from the exterior surface of the fuel rail, wherein the projection is formed by disposing an adapter surrounding the at least one aperture of the fuel rail.

8. The fuel system according to claim 7, wherein the body further comprises a deformed portion disposed on the exterior surrounding the aperture, the projection disposed on the deformed portion.

9. The fuel system according to claim 7, wherein the rigid connection is formed by welding.

10. The fuel system according to claim 1, wherein the at least one aperture comprises a multiplicity of apertures, and the at least one fuel injector comprises a multiplicity of fuel injectors.

11. A method of reducing hydrocarbon leakage within a fuel system, comprising:

providing at least one fuel injector having an inlet tube assembly containing a valve assembly with an inlet tube, and at least one aperture in a fuel rail with a body having an interior surface to define a volume and an exterior surface surrounding the interior surface, the at least one aperture in fluid communication with the volume;

rigidly connecting the inlet tube contiguous to at least one of the interior and exterior surfaces of the fuel rail that surrounds the at least one aperture to secure and hermetically seal the inlet tube to the fuel rail with the volume of the fuel injector.

12. The method according to claim 11, wherein rigidly connecting comprises rigidly connecting the inlet tube with the exterior surface of the fuel rail.

13. The method according to claim 12, further comprising:

forming a projection on the exterior surface of the fuel rail that extends away from the volume and surrounds the aperture.

14. The method according to claim 13, wherein forming the projection comprises forming the projection by extruding a portion of the body.

15. The method according to claim 14, wherein rigidly connecting comprises rigidly connecting via welding.

16. A method of reducing hydrocarbon leakage within a fuel system, comprising:

providing an least one aperture in a fuel rail with a body having an interior surface to define a volume and an exterior surface surrounding the interior surface, the at least one aperture in fluid communication with the volume;

rigidly connecting an inlet tube of at least one fuel injector with at least one of the interior and exterior surfaces of the fuel rail that surrounds the at least one aperture to secure and hermetically seal the inlet tube to the fuel rail with the volume of the fuel injector, the rigidly connecting comprises rigidly connecting the inlet tube with the exterior surface of the fuel rail; and forming a projection on the exterior surface of the fuel rail that extends away from the volume and surrounds the aperture, wherein the forming of the projection comprises forming the projection by disposing an adapter on the exterior surface that surrounds the at least one aperture.

17. The method according to claim 16, further comprising:

deforming a portion of the exterior surface that surrounds the at least one aperture.

18. The method according to claim 17, wherein rigidly connecting comprises rigidly connecting via welding.

19. The method according to claim 11, wherein providing the at least one aperture comprises providing a plurality of apertures.

20. The method according to claim 19, wherein rigidly connecting the inlet tube of the at least one fuel injector comprises rigidly connecting the inlet tubes of a plurality of fuel injectors.

* * * * *